US006447209B1

(12) United States Patent
Ruiz et al.

(10) Patent No.: US 6,447,209 B1
(45) **Date of Patent: *Sep. 10, 2002**

(54) APPARATUS FOR MOUNTING POWER CYLINDERS FOR DRIVING PIERS

(75) Inventors: Richard Dean Ruiz, Des Peres; Troy Dean Ruiz, St. Louis; Scott Allen Ruiz, Kirkwood, all of MO (US)

(73) Assignee: Richard D. Ruiz, LLC, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/706,922

(22) Filed: Nov. 6, 2000

Related U.S. Application Data

(63) Continuation-in-part of application No. 09/337,598, filed on Jun. 21, 1999, now Pat. No. 6,152,654.

(51) Int. Cl.[7] ..... E02D 11/00; E02D 13/00; E02D 7/00

(52) U.S. Cl. ..... 405/232; 405/229; 405/230

(58) Field of Search ..... 405/229, 230, 405/232, 248, 244

(56) References Cited

U.S. PATENT DOCUMENTS

| | | | | |
|---|---|---|---|---|
| 2,982,103 A | | 5/1961 | Revisz et al. | |
| 3,763,654 A | | 10/1973 | Matsushita | |
| 3,796,055 A | | 3/1974 | Mahony | |
| 3,992,890 A | | 11/1976 | Pryke | |
| 4,405,115 A | | 9/1983 | Boyadjieff | |
| 4,673,315 A | | 6/1987 | Shaw et al. | |
| 4,678,373 A | | 7/1987 | Langengach, Jr. | |
| 4,695,203 A | | 9/1987 | Gregory | |
| 4,765,777 A | | 8/1988 | Gregory | |
| 4,925,345 A | | 5/1990 | McGown, Jr. et al. | |
| 5,006,015 A | * | 4/1991 | Stephens et al. | 405/230 |
| 5,154,539 A | * | 10/1992 | McCown, Sr. et al. | 405/230 |
| 5,206,673 A | * | 4/1993 | Boin et al. | 405/230 |
| 5,492,437 A | * | 2/1996 | Oritz | 405/230 |
| 5,722,798 A | * | 3/1998 | Gregory | 405/230 |
| 5,800,094 A | * | 9/1998 | Jones | 405/230 |
| 5,980,162 A | * | 11/1999 | MCown | 405/244 |
| 6,074,133 A | * | 6/2000 | Kelsey | 405/244 |
| 6,079,905 A | * | 6/2000 | Ruiz et al. | 405/230 |
| 6,142,710 A | * | 11/2000 | Holland, Jr. et al. | 405/230 |
| 6,193,422 B1 | * | 2/2001 | May | 405/232 |

* cited by examiner

*Primary Examiner*—Thomas B. Will
*Assistant Examiner*—Alexandra K. Pechhold
(74) *Attorney, Agent, or Firm*—Greensfelder, Hemker & Gale, P.C.

(57) ABSTRACT

A device for use with a pier installation apparatus of the type employed in lifting and supporting a foundation is provided. A mounting beam assembly for mounting hydraulic power cylinders in a straddling position around a pier to be driven into the ground by the installation apparatus. The beam assembly is a planar member having a central opening for receiving the pier therethrough. It is comprised of opposing plate members beneath which the hydraulic cylinders are mounted. The plate members each have an opening which allows passage of the piston rod through the hydraulic cylinder. Alternatively, the beam assembly may be comprised of a unitary plate member having a lateral opening at a side edge. The mounting beam assembly allows for lateral placement around a pier in the installation apparatus, and may be completely disassembled for quick and efficient installation and removal.

15 Claims, 5 Drawing Sheets

APPARATUS FOR MOUNTING POWER CYLINDERS FOR DRIVING PIERS

RELATED APPLICATION

This application is a continuation-in-part of application Ser. No. 09/337,598, filed Jun. 21, 1999 now U.S. Pat. No. 6,152,654.

BACKGROUND OF THE INVENTION

The present invention is broadly concerned with apparatuses for raising and supporting a shallow footing or foundation that has settled due to inadequate compaction of soil and other fill material due to erosion, soil consolidation, dehydration, or other causes. Various piering systems are currently in use for this purpose, and utilize piers of varying configuration and materials including wood, concrete, reinforced concrete, steel pipe, and steel bar stock. A pier is installed underneath or adjacent to a failed footing, and then the load of the footing is transferred to the installed pier by a bracket or load transfer device that is attached to the footing.

This invention deals specifically with a method and apparatus to be used for the installation of pipe piers. In the current art, a pipe pier is advanced into the ground using hydraulic driving cylinders, such as jacks, until a predetermined resistance against the pier is met. The pier is then terminated at an elevation that will allow a foundation load to be transferred to it via a bracket or load transfer mechanism connected to the foundation.

Pipe pier installation apparatuses utilizing either single or dual cylinder assemblies are typically used, whereby pier sections are added, section by section, as the pier is advanced into the ground. The depth to which a pier can be advanced is dictated by soil conditions, the driving force of the hydraulic cylinder(s), and the overall strength of the installation assembly.

Single cylinder installation assemblies push piers into the ground, with the piston rod pushing directly on top of the pier, while dual cylinder assemblies are typically inverted, utilizing a reaction to their driving force to pull the pier. One drawback of the single cylinder system is driving force. To develop enough driving force to push piers through dense soils, a single cylinder will either require a prohibitively large diameter, or an additional strength requirement to accept higher hydraulic pressures. The larger diameter cylinder becomes more awkward to handle in the field, and more prone to leakage. The use of high-pressure cylinders increases weight, which again makes the apparatus more cumbersome in the field, and requires larger and costlier hydraulic motors. Another shortfall of the single cylinder, push pier apparatuses currently in use is that they limit the length of pier sections that can be driven. For a single cylinder to be used in driving a pier, it must be concentrically positioned above the pier. This limits pier section lengths to the height inside the apparatus less the space taken up by the mounted cylinder, which impedes installation by requiring the constant insertion and removal of spacers.

Dual cylinder assemblies are more frequently used, as they resolve many of the problems attendant with single cylinder systems. The dual cylinders straddle the pier sections, and thus the pier sections are not limited in length by the available distance above the top of the pier within the installation assembly. Present art pertaining to dual cylinder assemblies often utilizes inverted cylinders that pull the pier into the ground as piston rods are retracted into the cylinders. In this arrangement, the pressurized cylinder chambers used in driving the pier contain the piston rods. As hydraulic fluid is pumped into the cylinders, it cannot act against the entire surface area of the pistons, as some of the available area is taken up by the piston rods. The chambers absent of the piston rods are pressurized during the backstroke, to position the apparatus for the next advancement. The cylinders are therefore not being used in their most effective manner when inverted.

Direct drive power cylinders are employed in the prior art whereby their full hydraulic capacity is used when driving piers. While this is the most efficient manner for driving piers, the assembly hardware for installing the power cylinders can be extremely heavy and unwieldy in the field. The efficiency of workers who must install the apparatus to the piers and supported foundation must be taken into consideration; a lighter power cylinder assembly would lead to faster installations, while causing less fatigue and injuries to the worker. It would be advantageous to have an apparatus for easily and quickly mounting a power cylinder to an assembly for driving a pier into the ground adjacent a footing to be supported.

SUMMARY OF THE INVENTION

The present invention utilizes a cylinder mounting beam assembly that allows hydraulic cylinders to be positioned within the installation apparatus such that they can utilize their full capacity when driving piers. The cylinder mounting beam assembly is adapted to be used in connection with currently existing pier driving apparatuses of the type which provide for placement of two offset hydraulic cylinders that straddle the pier. The pistons of the hydraulic cylinders are connected to a clamping member which grips the pier for urging the pier into the ground. This type of pier driving apparatus further has driving arm members, against which the power cylinders are indirectly braced, which engage the footing, such as through a bracket or other load transfer mechanism placed underneath the footing.

The invention comprises a planar pier retaining member having a central opening for receiving the pier and has connection points for attachment to the driving arm members of the pier driving apparatus. Top ends of the hydraulic cylinders are connected to the bottom side of the planar pier retaining member with the piston rod ends of the hydraulic cylinders depending downwardly to connect with the clamping members that engage the pier to be driven. In this arrangement, the hydraulic cylinders are able to drive the pier utilizing the push stroke of the piston rod instead of the back stroke. In one embodiment of the invention, the pier retaining member is comprised of plate members capable of disassembly, so that the mounting beam assembly may be broken down into separate components. This arrangement allows the pier driving process of the footing supporting operation to proceed much more efficiently in that the mounting beam assembly is of a reduced weight, making it easier for the worker to lift, and also because installation of the mounting beam assembly can be done laterally around the pier rather than sliding down over the top of the pier. Another embodiment features a unitary planar pier retaining member having an opening at its lateral side to receive the pier.

It is therefore an object of the invention to provide a hydraulic cylinder mounting beam assembly which can be used in connection with existing foundation supporting bracket assemblies. It is a further object of the invention to provide a hydraulic cylinder mounting beam assembly which is capable of mounting the hydraulic cylinders in such a way that the direct power stroke of the piston rods is utilized. It is still further an object of this invention to provide an embodiment of a hydraulic cylinder mounting beam assembly which is capable of disassembly into component parts. It is still further an object of this invention to provide a mounting beam assembly that permits lateral installation onto the pier.

The above features are objects of this invention. Further objects will appear in the detailed description which follows and will be otherwise apparent to those skilled in the art.

For purpose of illustration of this invention preferred embodiments are shown and described hereinbelow in the accompanying drawing. It is to be understood that this is for the purpose of example only and that the invention is not limited thereto.

DESCRIPTION OF THE INVNETION

Figure 4:
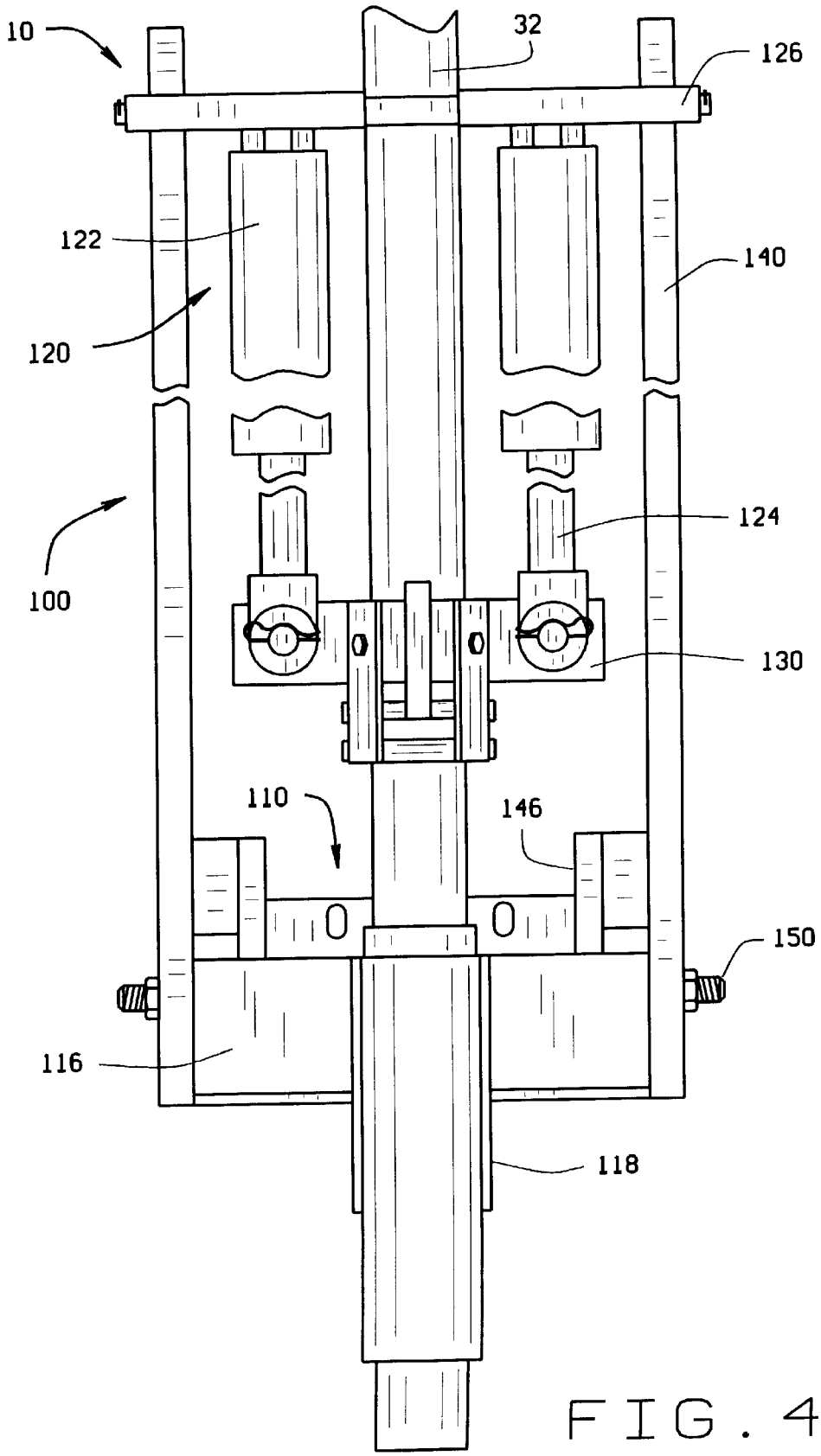
FIG. 4 is a front view of a pier driving assembly utilizing the cylinder mounting beam assembly shown with a pier section and load transfer mechanism.
Figure 5:
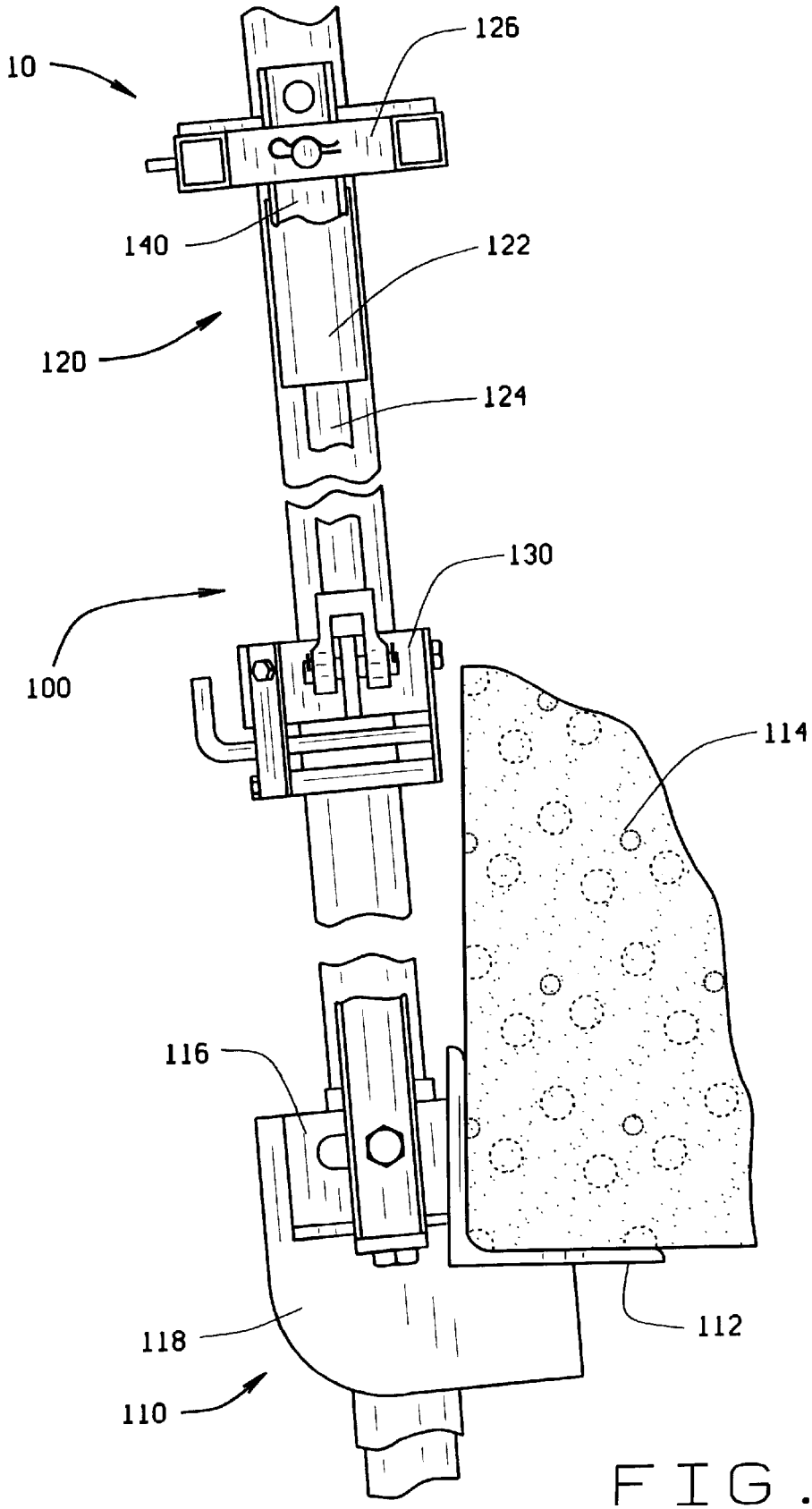
FIG. 5 is a side view, partially broken away, of the pier driving assembly utilizing the cylinder mounting beam assembly shown with a pier section and load transfer mechanism.

The invention comprises an improvement to apparatuses of the type used for driving piers into the ground for supporting a building foundation or footing. This type of apparatus, indicated by the reference numeral 100, is generally known to those having skill in the art and is shown in FIGS. 4 and 5 which is modified to incorporate the invention. For an understanding of how the instant invention is employed, a brief description of the pier installation apparatus is provided herewith. As this type of apparatus is understood by those skilled in the art, certain standard components are shown partially broken away.

The typical pier installation apparatus 100 is comprised of a footing engaging bracket assembly 110, hydraulic driving elements 120, pier clamp 130, and a pair of driving assembly arms 140. The footing engaging bracket assembly is comprised of an L-shaped member 112 upon which a footing 114 is supported, a load transferring bracket 116 and pier guide plates 118. The hydraulic driving elements 120 are comprised of hydraulic jack cylinders 122 which have an extending piston rod 124 that engage pier clamp 130. The jack cylinders 122 are mounted to an element 126 that engages driving assembly arms 140 which in turn are braced against load transferring bracket 116. To drive a pier into the ground, piston rods 124 are extended, which causes pier clamp 130 to grip the pier. Pier clamps may be of either the type that are manually closed around the pier, or, alternately, a slip clamp that engages the pier upon a downward stroke of the piston and releases upon retraction. Because the hydraulic driving elements 120 are indirectly braced against the foundation footing 114 through bracket assembly 110, a downward driving force is exerted upon the pier. After the piston rods 124 have reached their full extended range, the clamp 130 is released from the pier, and the piston rods are retracted back to their preload condition for the next driving cycle. This process is well-known in the art and itself forms no part of the invention per se.

Figure 1:
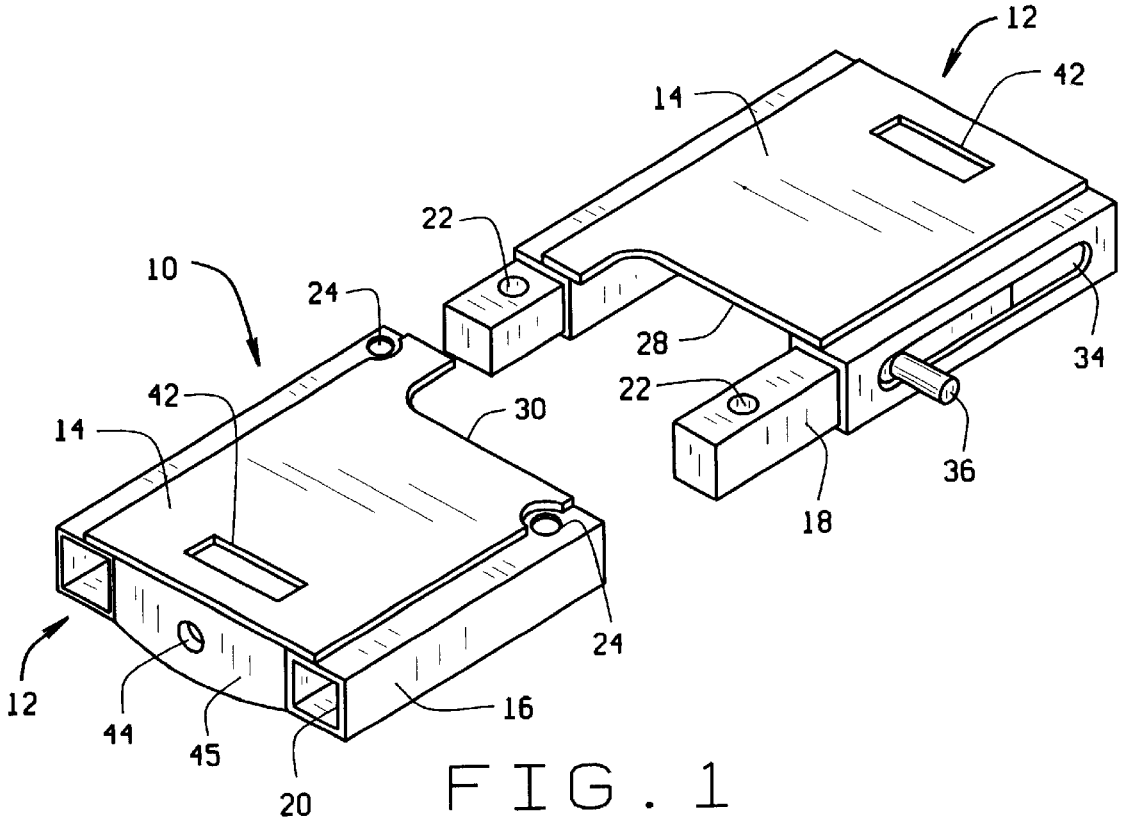
FIG. 1 is a perspective view of one embodiment of the cylinder mounting beam assembly.

The instant invention relates to an improvement to the manner of mounting the hydraulic cylinders to the pier installation apparatus. It comprises a planar mounting beam assembly and is generally referred to by the reference numeral 10 as shown in FIG. 1, which shows a first embodiment of the invention. In this embodiment, beam assembly 10 is formed from a pair of opposing, co-planar mounting plate members 12 that are optimally formed, for providing rigidity to the assembly, from steel plates 14 with reinforced lateral sides 16 formed from square bar stock or hollow metal tubing, interconnected by means of welds, or can be formed of one piece. The mounting plate members 12 are separable from each other, and are joined together by insertion of square bar stock members or dowels 18 extending from one plate member into the opening 20 of hollow metal tubing 16 of the other plate member as shown in FIG. 1. Dowel 18 is provided with a hole 22 which is brought into alignment with hole 24 in metal tubing 16 which may receive a locking pin for insertion therein to secure the respective mounting plates together. If desired, one end of the dowel may be welded within the hollow metal tubing of one plate member, so that it leaves only one free end to be secured. Alternately, dowel 18 may slide freely within the hollow tubing of both plate members with holes 24 being provided in both plate members. Recessed areas 28 and 30 are formed into steel plates 14 such that a gap remains for pier 32 to pass through. A plurality of holes spaced incremently apart (not shown) may be provided in dowel member 18 (or metal tubing 16) so that the dimensions of the gap may be adjusted to accommodate various size piers.

To make the connection process more efficient, hollow metal tubing 16 may be provided with a slot 34 formed therein along its exterior lateral side, and dowel 18 is provided with a finger member 36 which extends through slot 34 to enable a sliding breech bolt action of the dowel within the hollow tubing. One or both lateral sides of the mounting plate member 12 may be equipped with the sliding breech bolt dowel; however, only one side need be so constructed because lateral installment of the mounting beam assembly only requires that one side of the assembly to be open to receive the pier. This lateral installment capability is especially advantageous when the installation apparatus is used in confined areas, where overhead clearance is limited so that it would be difficult to place a power cylinder mounting beam over the top of the extended pier.

Figure 2:
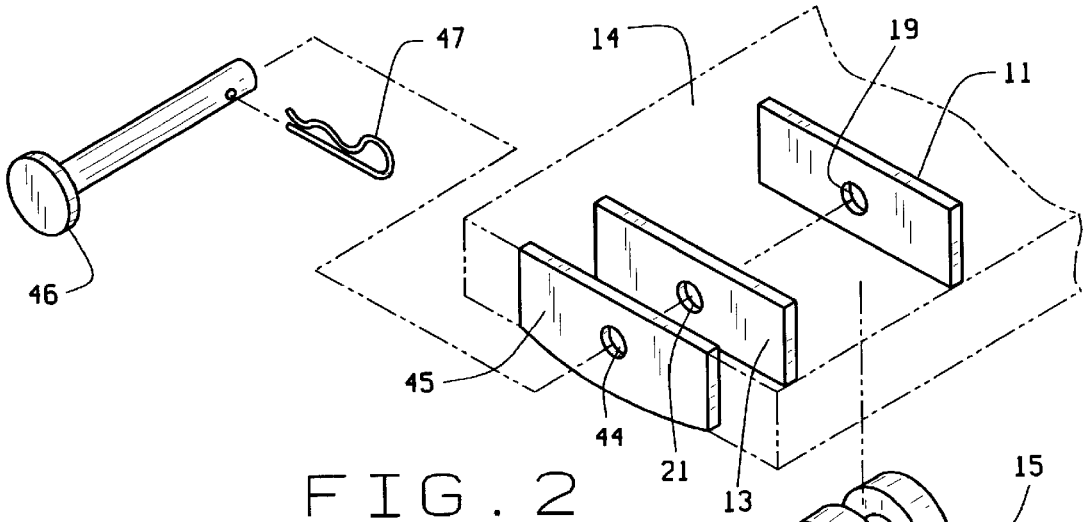
FIG. 2 is a perspective view, partially broken away, of the mounting beam member showing the manner of attachment of the hydraulic driving element.

The cylinder mounting beam assembly functions as a mounting platform for the hydraulic cylinders, and as a reaction beam from which driving force of the piers is exerted. The underneath sides of plates 14 are each provided with a flange 11 for receiving forked connector member 15 of power cylinder 122 as seen in FIG. 2. Forked connector member 15 has apertures 17 which align with aperture 19 provided in flange 11. A pin or bolt may be placed through the aligned apertures to hold cylinder 122 in a downwardly depending arrangement below mounting beam assembly 10 as shown in FIG. 4. It is to be understood by persons having ordinary skill in the art that other means of attachment of the power cylinders may be employed, such as by direct bolting to the underneath side of plate 14. Slots 42 are provided in plate 14 to receive driving arm members 140 which are secured to the mounting plate by bolts or clevis pins through hole 44 provided in end plate 45. Alternate connection methods of attachment of the driving arm members 140 to the mounting plate can also be employed, such as connecting the driving arms to the outer side of the mounting plate.

Figure 3:
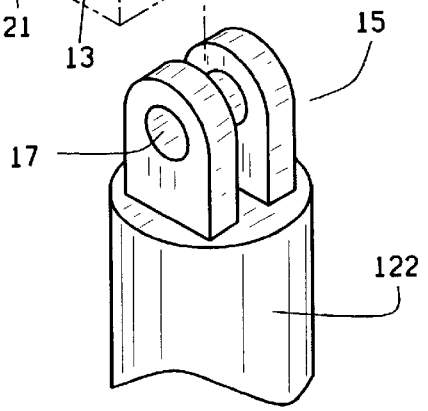
FIG. 3 is a perspective view of a driving assembly arm member which is used to brace the cylinder mounting beam assembly against a foundation load transfer assembly.
Figure 3:
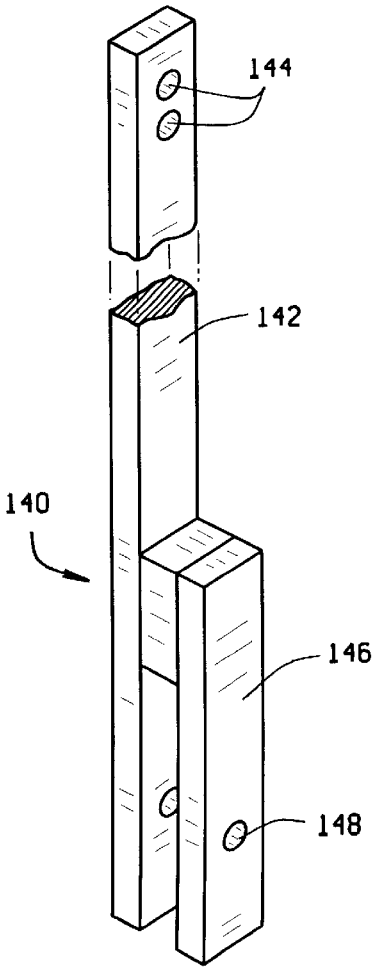

FIGS. 4 and 5 show the cylinder mounting beam assembly in operation with the pier driving apparatus. After the assembly 10 is placed around pier 32, and prior to mounting the power cylinders 122, the mounting plate members 12 are connected to each other by manipulation of the breech action of dowel member 18 as discussed above. The driving arm members 140 pass through the slots 42 of the mounting plates and are connected thereto by bolt or pin 46 through hole 44. Flange 13 may be provided underneath the mounting plate in a spaced, adjacent relationship with end plate 45 to provide a stable connection point for driving arm member 140. Flange 13 has an aligned aperture 21 for receiving pin 46. Pin 46 may also pass through the aligned apertures 17 and 19 to secure power cylinder 122 to the underneath side of the mounting plate as described above. Cotter pin 47 secures pin 46 in place. FIG. 3 shows the general structure of one embodiment of driving arm member 140 which comprises an elongated flat bar shaft 142 that spans the distance between mounting beam assembly 10 and footing engaging bracket assembly 110. A plurality of holes 144 may be provided at the top of arm member 140 to allow the cylinder mounting beam assembly to be positioned on the pier at the optimum elevation that will allow the maximum stroke of the hydraulic piston rods. The bottom end of the driving arm is adapted to engage load transfer bracket 116, which, as shown in FIG. 3, is a fork-shaped connector end 146. Holes 148 are provided on connector end 146 for connection to load transfer bracket 116 by bolt or pin 150.

Figure 6:
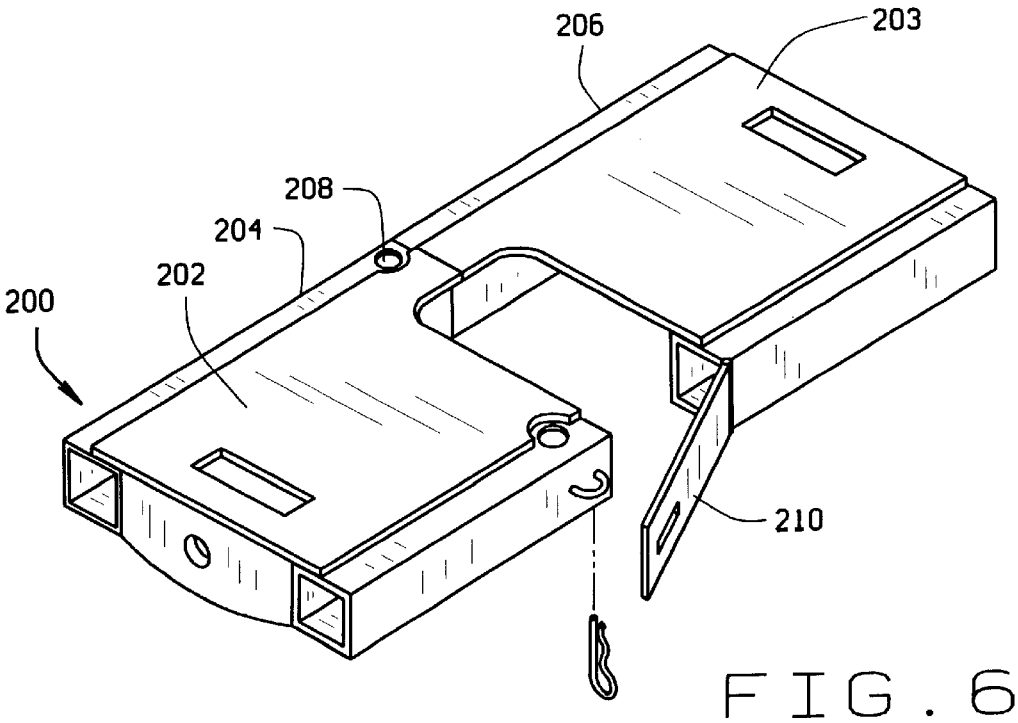
FIG. 6 is a perspective view of a further embodiment of the cylinder mounting beam assembly.

FIG. 6 shows another embodiment 200 of the invention which is somewhat similar in construction to that shown in FIG. 1. In this embodiment, connection of the mounting plate members 202 and 203 to each other is effected through a hinged relationship. Lateral side 204 is formed from hollow square tubing and receives an extended tongue element (not shown) of lateral side 206 which serves to engage the opposing mounting plates to each other. Holes 208 are provided in each of lateral side 204 and the extended tongue element for alignment therebetween for insertion of a connection pin whereupon a hinged relationship between the mounting plates is created. The mounting plates are swung open along their common plane to receive the pier. A fastener such as hasp 210 is provided so that the mounting plate assembly may be closed around the pier.

Figure 7:
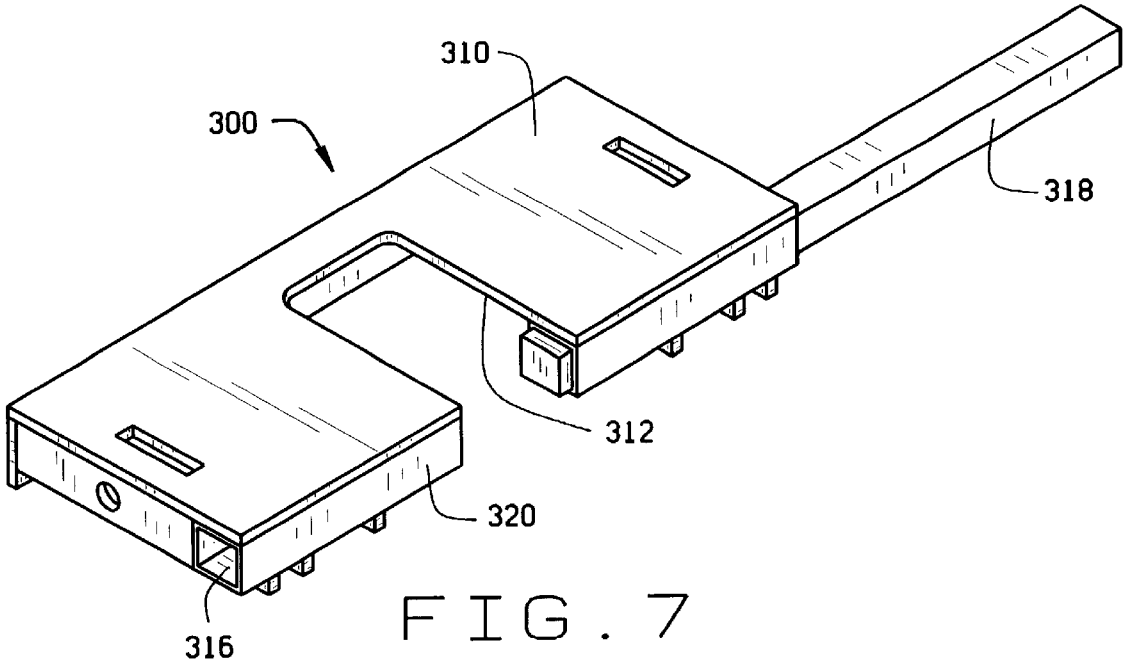
FIG. 7 is a perspective view of a further embodiment of the cylinder mounting beam assembly.
Figure 8:
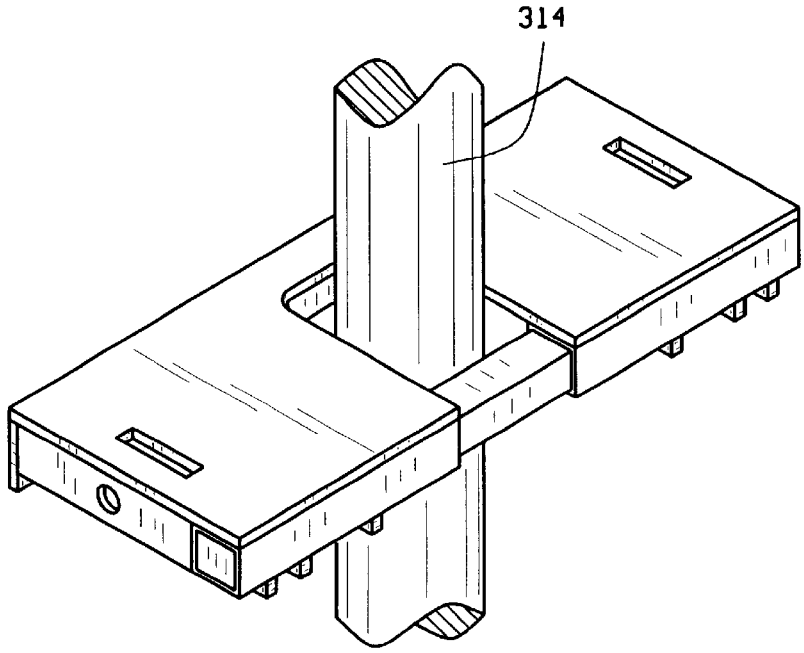
FIG. 8 is a perspective view of the embodiment of the cylinder mounting beam assembly of FIG. 7 in which a pier is received.

FIGS. 7 and 8 show a third embodiment 300 of the mounting plate assembly which is constructed of a unitary mounting plate member 310. It has a recessed area 312 for receiving a pier 314. The recessed area opens to a front lateral side 320 of plate member 310 to allow the mounting plate assembly to be installed laterally around a pier to be driven. The driving arms and power cylinders (not shown) are attached to the mounting plate assembly in the same manner as the earlier described embodiments. Similarly, plate member 310 forms a hollow channel 316 at front lateral side 320 in which a dowel 318 is slidably received. Dowel 318 may therefore be opened and closed to receive and retain pier 314 within the mounting plate assembly.

Various changes and modifications may be made within this invention as will be apparent to those skilled in the art. Such changes and modifications are within the scope and teaching of this invention as defined in the claims appended hereto.

What is claimed is:

1. In an apparatus for driving piers into the ground for a purpose of supporting a foundation structure, said apparatus comprising at least two hydraulic driving elements disposed in an offset position adjacent a pier, said hydraulic driving elements having means for gripping said pier, said hydraulic driving elements being braced against a member having driving arm members in connection with said foundation, said pier being able to be driven into the ground by actuation of said hydraulic driving elements such that a downward driving force is applied to said pier, an improvement comprising a hydraulic driving element mounting beam assembly, said mounting beam assembly comprising a planar pier retaining member having a central opening for receiving said pier perpendicularly therethrough, and means for receiving said driving arm members, said pier retaining member comprising a pair of opposing hydraulic driving element mounting plate members, said hydraulic driving element mounting beam assembly being capable of disassembly such that each one of said respective pairs of said hydraulic driving element mounting plate members are separable from each other, whereby lateral attachment of said hydraulic driving element mounting beam assembly around said pier is enabled, a hydraulic driving element being supported below each of said hydraulic driving element mounting plate members of said mounting beam assembly, with a piston of said hydraulic driving element depending below said mounting plate member.

2. The apparatus of claim 1 in which said hydraulic driving element mounting plate members have lateral edges forming elongated, hollow tubular members, said tubular members being adapted to receive a dowel member therein when said pairs of mounting plate members are aligned around said pier, whereby joining of said mo unting plate members is effected.

3. The apparatus of claim 2 in which said dowel member is slidably receivable in said hollow tubular members, at least one of said hollow tubular members having formed in a side wall therein an elongated slot , said dowel member having a finger member extending through said slot, whereby said dowel member is moveable within said hollow tubular members by manipulation of said finger member.

4. The apparatus of claim 2 in which said dowel member is provided with at least one hole, and at least one of said hollow tubular members is provided with at least one reciprocal hole, said hole of said dowel member and one of said at least one reciprocal hole being capable of alignment such that a fastener is receivable through said alignment of holes for connecting said hydraulic driving element mounting plate members.

5. The apparatus of claim 4 in which said at least one of said hollow tubular members is provided with a plurality of reciprocal holes arranged an incremental distance from each other along a length of said tubular member, whereby adjustment to an effective pier-accommodating diameter of said central opening can be effected.

6. The apparatus of claim 1 in which said hydraulic driving element mounting plate members are hingedly connected such that said mounting plate members are swung open along their common plane to receive therebetween said pier.

7. The apparatus of claim 6 in which an end of one of said mounting plate members has an extended engagement member, said engagement member being connected in hinged relationship to an opposing end of other of said mounting plate members, said apparatus having a fastener to effect connection of said mounting plate members around a pier.

8. The apparatus of claim 7 in which said fastener comprises a hasp member disposed alongside said mounting plate members.

9. The apparatus of claim 1 in which each of said hydraulic driving element mounting plate member has a channel for receiving transversely therethrough said driving arm members, fasteners being provided for securing said driving arm members to said mounting plate members.

10. In an apparatus for driving piers into the ground for a purpose of supporting a foundation structure, said apparatus comprising at least two hydraulic driving elements disposed in an offset position adjacent a pier, said hydraulic driving elements having means for gripping said pier, said hydraulic driving elements being braced against a member having driving arm members in connection with said foundation, said pier being able to be driven into the ground by actuation of said hydraulic driving element such that a downward driving force is applied to said pier, an improvement comprising a hydraulic driving element mounting beam assembly, said mounting beam assembly comprising a horizontally disposed planar pier retaining member having a central opening for receiving said pier perpendicularly therethrough, and means for receiving said driving arm members, said planar pier retaining member defining an opening along a lateral edge thereof to receive said pier, whereby lateral attachment of said hydraulic driving element mounting beam assembly around said pier is enabled.

11. The apparatus of claim 10 in which said lateral edge of said planar pier retaining member defines elongated, hollow tubular passages on opposite sides of said defined opening, said tubular passages being adapted to receive a dowel member therein to retain said pier within said mounting beam assembly.

12. The apparatus of claim 11 in which said dowel member is slidably receivable in said hollow tubular passages, at least one of said hollow tubular passages having formed in a side wall therein an elongated slot, said dowel member having a finger member extending through said slot, whereby said dowel member is moveable within said hollow tubular passages by manipulation of said finger member.

13. The apparatus of claim 11 in which said dowel member is provided with at least one hole, and at least one of said hollow tubular passages is provided with at least one reciprocal hole, said hole of said dowel member and one of said at least one reciprocal hole being capable of alignment such that a fastener is receivable through said alignment of holes for locking said dowel member in retaining relationship within said tubular passages.

14. The apparatus of claim 10 in which said planar pier retaining member has a channel for receiving transversely therethrough said driving arm members, fasteners being provided for securing said driving arm members to said planar pier retaining member.

15. The apparatus of claim 10 in which said hydraulic driving elements are supported below said planar pier retaining member.

* * * * *